US007700529B1

(12) United States Patent
Closson et al.

(10) Patent No.: US 7,700,529 B1
(45) Date of Patent: Apr. 20, 2010

(54) ISOMERS OF BICYCLO[2.2.1]HEPT-5-ENE-2-CARBOXYLIC ACID, ETHYL ESTER AND THEIR USE IN PERFUME COMPOSITIONS

(75) Inventors: Adam P. Closson, Red Bank, NJ (US); Anthony T. Levorse, Jr., Westfield, NJ (US); Michael G. Monteleone, Hazlet, NJ (US)

(73) Assignee: International Flavors & Fragrances Inc., New York, NY (US)

( * ) Notice: Subject to any disclaimer, the term of this patent is extended or adjusted under 35 U.S.C. 154(b) by 0 days.

(21) Appl. No.: 12/250,811

(22) Filed: Oct. 14, 2008

(51) Int. Cl.
*C11D 3/50* (2006.01)

(52) U.S. Cl. ..... 510/105; 512/17; 560/128

(58) Field of Classification Search ..... 510/105; 512/17; 560/128
See application file for complete search history.

(56) References Cited

U.S. PATENT DOCUMENTS 2,425,173 A * 8/1947 Bruson ..... 560/228
3,053,882 A * 9/1962 Miller ..... 560/117
3,715,330 A * 2/1973 Nogami et al. ..... 523/512
4,374,054 A * 2/1983 Klemarczyk et al. ..... 512/17
4,486,220 A * 12/1984 Payne ..... 504/236
2006/0128996 A1 6/2006 Vaultier et al.

OTHER PUBLICATIONS

Mamedov, M.K. "Synthesis of Diesters of Bicyclic Diols and Carboxylic Acids." Russian Journal of Organic Chemistry (1997) 33(2), pp. 169-171.
Fringuelli, F. et al. "[AlCl3 + 2THF]: A New and Efficient Catalytic System for Diels-Alder Cycloaddition of α,β-Unsatured Carbonyl Compounds under Solvent-Free Conditions." Org. Lett, (2006) 8, pp. 2487-2489.

* cited by examiner

*Primary Examiner*—John R Hardee
(74) *Attorney, Agent, or Firm*—Elizabeth M. Quirk; XuFan Tseng; Joseph F. Leightner

(57) ABSTRACT

The present invention is directed to a fragrance compound of bicyclo[2.2.1]hept-5-ene-2-carboxylic acid, ethyl ester:

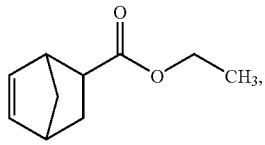

and its isomeric compounds.

7 Claims, No Drawings

ISOMERS OF BICYCLO[2.2.1]HEPT-5-ENE-2-CARBOXYLIC ACID, ETHYL ESTER AND THEIR USE IN PERFUME COMPOSITIONS

FIELD OF THE INVENTION

The present invention relates to new chemical entities and the incorporation and use of the new chemical entities as fragrance materials.

BACKGROUND OF THE INVENTION

There is an ongoing need in the fragrance industry to provide new chemicals to give perfumers and other persons the ability to create new fragrances for perfumes, colognes and personal care products. Those with skill in the art appreciate how differences in the chemical structure of the molecule can result in significant differences in the odor, notes and characteristics of a molecule. These variations and the ongoing need to discover and use the new chemicals in the development of new fragrances allow the perfumers to apply the new compounds in creating new fragrances.

SUMMARY OF THE INVENTION

The present invention provides novel chemicals, and the use of the chemicals to enhance the fragrance of perfumes, toilet waters, colognes, personal products and the like. In addition, the present invention is directed to the use of the novel chemicals to enhance fragrance in perfumes, toilet waters, colognes, personal products and the like.

More specifically, the present invention is directed to a fragrance compound of bicyclo[2.2.1]hept-5-ene-2-carboxylic acid, ethyl ester represented by Formula I set forth below:

Formula I

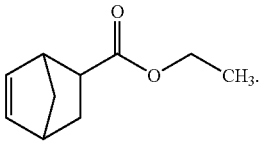

In particular, the following isomeric compounds are disclosed:

Formula II

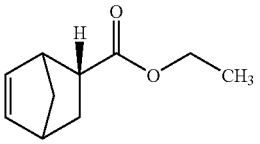

Formula III

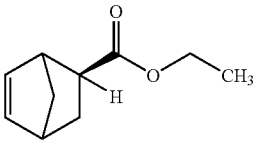

Another embodiment of the invention is directed to a fragrance formulation comprising the isomeric compounds of bicyclo[2.2.1]hept-5-ene-2-carboxylic acid, ethyl ester provided above.

Another embodiment of the invention is directed to a method for enhancing a perfume composition by incorporating an olfactory acceptable amount of the isomeric compounds of bicyclo[2.2.1]hept-5-ene-2-carboxylic acid, ethyl ester provided above.

Another embodiment of the invention is directed to a fragrance formulation comprising endo bicyclo[2.2.1]hept-5-ene-2-carboxylic acid, ethyl ester (Formula II) provided above and a method for enhancing a perfume composition by incorporating an olfactory acceptable amount of the endo isomeric compound.

Yet another embodiment of the invention is directed to a fragrance formulation comprising exo bicyclo[2.2.1]hept-5-ene-2-carboxylic acid, ethyl ester (Formula III) provided above and a method for enhancing a perfume composition by incorporating an olfactory acceptable amount of the exo isomeric compound.

These and other embodiments of the present invention will be apparent by reading the following specification.

DETAILED DESCRIPTION OF THE INVENTION

Those with the skill in the art will appreciate that Formula I above represents a compound of bicyclo[2.2.1]hept-5-ene-2-carboxylic acid, ethyl ester;

Formula II above represents a compound of endo bicyclo [2.2.1]hept-5-ene-2-carboxylic acid, ethyl ester; and Formula III above represents a compound of exo bicyclo [2.2.1]hept-5-ene-2-carboxylic acid, ethyl ester.

The compounds of the present invention may be prepared via a Diels Alder reaction of ethyl acrylate (commercially available at Aldrich Chemical Company, Inc.) with cyclopentadiene (freshly prepared by cracking dicyclopentadiene, which is commercially available at Aldrich Chemical Company, Inc.).

Those with skill in the art will recognize that some of the compounds of the present invention have a number of chiral centers, thereby providing numerous isomers of the claimed compounds. It is intended herein that the compounds described herein include isomeric mixtures of such compounds, as well as those isomers that may be separated using techniques known to those having skill in the art. Suitable techniques include chromatography such as high performance liquid chromatography, referred to as HPLC, and particularly gel chromatography and solid phase microextraction, referred to as SPME.

The use of the compounds of the present invention is widely applicable in current perfumery products, including the preparation of perfumes and colognes, the perfuming of personal care products such as soaps, shower gels, and hair care products, fabric care products, air fresheners, and cosmetic preparations. The present invention can also be used to perfume cleaning agents, such as, but not limited to detergents, dishwashing materials, scrubbing compositions, window cleaners and the like.

In these preparations, the compounds of the present invention can be used alone or in combination with other perfuming compositions, solvents, adjuvants and the like. The nature and variety of the other ingredients that can also be employed are known to those with skill in the art.

Many types of fragrances can be employed in the present invention, the only limitation being the compatibility with the other components being employed. Suitable fragrances include but are not limited to fruits such as almond, apple, cherry, grape, pear, pineapple, orange, strawberry, raspberry; musk, flower scents such as lavender-like, rose-like, iris-like, carnation-like. Other pleasant scents include herbal and woodland scents derived from pine, spruce and other forest smells. Fragrances may also be derived from various oils, such as essential oils, or from plant materials such as peppermint, spearmint and the like.

A list of suitable fragrances is provided in U.S. Pat. No. 4,534,891, the contents of which are incorporated by reference as if set forth in its entirety. Another source of suitable fragrances is found in *Perfumes, Cosmetics and Soaps*, Second Edition, edited by W. A. Poucher, 1959. Among the fragrances provided in this treatise are acacia, cassie, chypre, cyclamen, fern, gardenia, hawthorn, heliotrope, honeysuckle, hyacinth, jasmine, lilac, lily, magnolia, mimosa, narcissus, freshly-cut hay, orange blossom, orchid, reseda, sweet pea, trefle, tuberose, vanilla, violet, wallflower, and the like.

Olfactory effective amount is understood to mean the amount of compound in perfume compositions the individual component will contribute to its particular olfactory characteristics, but the olfactory effect of the perfume composition will be the sum of the effects of each of the perfumes or fragrance ingredients. Thus the compounds of the invention can be used to alter the aroma characteristics of the perfume composition, or by modifying the olfactory reaction contributed by another ingredient in the composition. The amount will vary depending on many factors including other ingredients, their relative amounts and the effect that is desired.

The level of compounds of the invention employed in the perfumed article varies from about 0.005 to about 10 weight percent, preferably from about 0.5 to about 8 and more preferably from about 1 to about 7 weight percent. In addition, other agents can be used in conjunction with the compounds. Well known materials such as surfactants, emulsifiers, polymers to encapsulate the fragrance can also be employed without departing from the scope of the present invention.

Another method of reporting the level of the compounds of the invention in the perfumed composition, i.e., the compounds as a weight percentage of the materials added to impart the desired fragrance. The compounds of the invention can range widely from about 0.005 to about 70 weight percent of the perfumed composition, preferably from about 0.1 to about 50 and more preferably from about 0.2 to about 25 weight percent. Those with skill in the art will be able to employ the desired level of the compounds of the invention to provide the desired fragrance and intensity.

When used in a fragrance formulation this ingredient provides freshness making the fragrance top notes more desirable and noticeable. It also has a spicy peppery odor which is very commonly used in men's fragrances added for fragrance appropriateness and desirability. The woody part of it is very useful in both men's and women's fragrances adding body and substantivity to the finished product. All of these odor qualities found in this material assist in beautifying and enhancing the finished accord improving the performance of the other materials in the fragrance. The floral of it will beautify as well and makes the fragrance more desirable and add the perception of value. There is also the fruity side of it which is found in many fragrances today which happens to be very trendy, especially for the younger consumer.

The following are provided as specific embodiments of the present invention. Other modifications of this invention will be readily apparent to those skilled in the art. Such modifications are understood to be within the scope of this invention. As used herein all percentages are weight percent unless otherwise noted, ppm is understood to stand for parts per million, L is understood to be liter, mL is understood to be milliliter, g is understood to be gram, and mmHg be millimeters (mm) of mercury (Hg). IFF as used in the examples is understood to mean International Flavors & Fragrances Inc., New York, N.Y., USA.

Example I

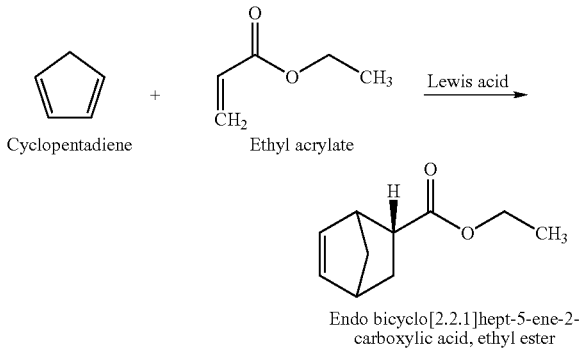

Preparation of endo bicyclo[2.2.1]hept-5-ene-2-carboxylic acid, ethyl ester: Ethyl acrylate (200 g, 1.99 mol, commercially available at Aldrich Chemical Company, Inc.) was dissolved in 500 ml of toluene. The resulting solution was then cooled to 0° C. using a dry ice isopropanol bath. Boron trifluoride etherate (28 g, 0.19 mol, commercially available at Aldrich Chemical Company, Inc.) was added to the solution. Cyclopentadiene (197 g, 2.98 mol, freshly prepared by cracking dicyclopentadiene, which is commercially available at Aldrich Chemical Company, Inc.). was then added to the cold solution dropwise. After the feed was complete the reaction mixture was aged for 1 hr. The crude reaction mixture was poured onto 2 L of 10% sulfuric acid and wet ice. The organic layer was removed and then washed with sodium carbonate solution until basic. Fractional distillation afforded endo bicycle[2.2.1]hept5-ene-2-carboxylic acid, ethyl ester (300 g, 90% yield), which had a boiling point of 82° C. at a pressure of 10 mmHg.

$^1$H NMR ($CDCl_3$, 500 MHz): 1.24 ppm (td, 3H, J=7.12, 0.73 Hz), 1.28 ppm (d, 1H, J=8.15 Hz), 1.43 ppm (d, 2H, J=8.53 Hz), 1.90 ppm (td, 1H, J=10.75, 3.43 Hz), 2.90 ppm (s, 1H), 2.92-2.96 ppm (m, 1H), 3.21 ppm (s, 1H), 4.05-4.13 ppm (m, 2H), 5.94 ppm (m, 1H), 6.19 ppm (m, 1H).

The compound was described as having fruity, sweet, and green notes.

Example II

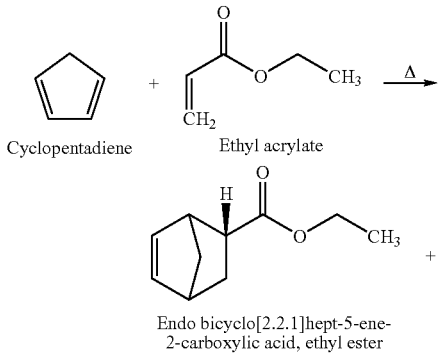

-continued

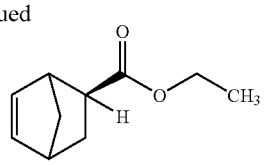

Exo bicyclo[2.2.1]hept-5-ene-2-carboxylic acid, ethyl ester

Preparation of endo and exo bicyclo[2.2.1]hept-5-ene-2-carboxylic acid, ethyl ester: Ethyl acrylate (361 g, 3.6 mol, commercially available at Aldrich Chemical Company, Inc.) and cyclopentadiene (238 g, 1.8 mol, freshly prepared by cracking dicyclopentadiene, which is commercially available at Aldrich Chemical Company, Inc.) were mixed in a stainless steel Parr reactor. The reactor was sealed and heated to 170° C. The reaction was aged for 2 hrs. The reactor was then cooled to an ambient temperature and the crude material was removed. Fractional distillation afforded a 3:1 mixture of endo/exo isomers (288.5 g, 48% yield) determined by GC analysis, which had a boiling point of 82° C. at a pressure of 10 mmHg.

$^1$H NMR ($CDCl_3$, 500 MHz): 1.23 ppm (t, ~40% of 3H, J=7.13 Hz), 1.26 ppm (t, ~60% of 3H, J=7.13 Hz), 1.23-1.26 ppm (m, 1H), 1.33-1.38 ppm (m, ~60% of 1H), 1.40-1.45 ppm (m, 1H), 1.53 ppm (d, ~40% of 1H, J=8.25 Hz), 1.86-1.95 ppm (m, 1H), 2.19-2.23 ppm (m, ~40% of 1H), 2.89-2.95 ppm (m, ~60% of), 3.03 ppm (s, ~40% of 1H), 3.20 ppm (s, ~60% of 1H), 4.03-4.12 ppm (m, ~60% of 2H), 4.14 ppm (q, ±40% of 2H), 5.92 ppm (dd, ~60% of 1H, J=5.63, 2.81 Hz), 6.10 ppm (dd, ~40% of 1H, J=5.53, 3.03 Hz), 6.13 ppm (dd, ~40% of 1H, J=5.55, 2.89 Hz), 6.18 ppm (dd, ~60% of 1H, J=5.61, 3.05 Hz)

The compound was described as having fruity, green, watery, and honey dew notes.

Example III

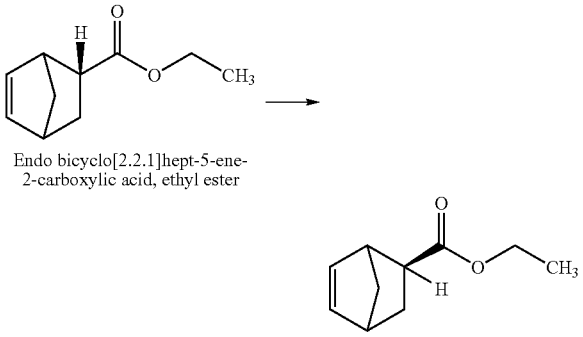

Endo bicyclo[2.2.1]hept-5-ene-2-carboxylic acid, ethyl ester

Exo bicyclo[2.2.1]hept-5-ene-2-carboxylic acid, ethyl ester

Isomerization of bicyclo[2.2.1]hept-5-ene-2-carboxylic acid, ethyl ester: An endo and exo isomeric mixture with a weight ratio of endo:exo at 45:1 (1 g) was dissolved in t-butanol (5 mL, commercially available at Aldrich Chemical Company, Inc.). Potassium t-butoxide (50 mg, commercially available at Aldrich Chemical Company, Inc.) was then added, and the reaction mixture was held at room temperature. Aliquots withdrawn after 1 hr and 24 hr of aging showed an isomeric ratio of endo:exo at 14:1.

The resulted exo bicyclo[2.2.1]hept-5-ene-2-carboxylic acid, ethyl ester has the following NMR spectral characteristics:

$^1$H NMR ($CDCl_3$, 500 MHz,): 1.26 ppm (t, 3H, J=7.13 Hz), 1.33-1.38 ppm (m, 2H), 1.53 ppm (s, 1H,), 1.86-1.95 ppm (m, 1H), 2.19-2.23 ppm (m, 1H), 2.89-2.95 ppm (m, 1H), 3.03 ppm (s, 1H), 4.14 ppm (q, 2H), 6.10 ppm (dd, 1H, J=5.53, 3.03 Hz), 6.13 ppm (dd, 1H, J=5.55, 2.89 Hz).

Example IV

The fragrance formulas exemplified as follows demonstrated that the addition of endo bicyclo[2.2.1]hept-5-ene-2-carboxylic acid, ethyl ester provided more dimension, and more creamy, edible, and fruity notes to the fragrance formula.

| Ingredient | Parts (grams) | Parts (grams) |
|---|---|---|
| Aldehyde AA Triplal | 2.00 | 2.00 |
| Aldehyde C10 | 1.00 | 1.00 |
| Allyl Caproate | 1.00 | 1.00 |
| Applelide ® | 10.00 | 10.00 |
| Bornafix ® | 1.00 | 1.00 |
| Cashmeran ® | 0.30 | 0.30 |
| DPG | 1.00 | — |
| Endo bicyclo[2.2.1]hept-5-ene-2-carboxylic acid, ethyl ester | — | 1.00 |
| Ethyl Vanillin | 0.30 | 0.30 |
| Ethyl-2-Methyl Butyrate | 10.00 | 10.00 |
| Floriffol ® | 10.00 | 10.00 |
| Galaxolide 50 pct DPG | 15.00 | 15.00 |
| Alpha Ionone | 2.00 | 2.00 |
| Kharismal ® | 10.00 | 10.00 |
| Lyral ® | 15.90 | 15.90 |
| Mimosa ABS BLO | 0.30 | 0.30 |
| Nebulone ® | 6.00 | 6.00 |
| Orange Oil FLA | 4.00 | 4.00 |
| Prenyl Acetate | 5.00 | 5.00 |
| Trisamber ® 1% DPG | 0.20 | 0.20 |
| Verdox ® | 5.00 | 5.00 |
| Total | 100.00 | 100.00 |

The above fragrance formulas had fruity, berries, sweet, aldehydic, creamy, slightly green, and cotton candy odor characters.

However, the fruity notes of the fragrance formulas containing endo bicyclo[2.2.1]hept-5-ene-2-carboxylic acid, ethyl ester became more intensified and more natural, as well as sweeter and more naturally smelling, which provided a combination of perfectly ripen tropical fruits notes to the overall fruitiness of the fragrance formula. Endo bicyclo[2.2.1]hept-5-ene-2-carboxylic acid, ethyl ester increased the overall odor strength of the fragrance formula, and accentuated each individual olfactive note.

Example V

Exo bicyclo[2.2.1]hept-5-ene-2-carboxylic acid, ethyl ester was further evaluated and demonstrated in the following fragrance formula:

| Ingredient | Parts (grams) |
|---|---|
| Aldehyde AA Triplal | 2.00 |
| Aldehyde C10 | 1.00 |

-continued

| Ingredient | Parts (grams) |
|---|---|
| Allyl Caproate | 1.00 |
| Applelide ® | 10.00 |
| Bornafix ® | 1.00 |
| Cashmeran ® | 0.30 |
| Endo and Exo bicyclo[2.2.1]hept-5-ene-2-carboxylic acid, ethyl ester | 1.00 |
| Ethyl Vanillin | 0.30 |
| Ethyl-2-Methyl Butyrate | 10.00 |
| Floriffol ® | 10.00 |
| Galaxolide 50 pct DPG | 15.00 |
| Alpha Ionone | 2.00 |
| Kharismal ® | 10.00 |
| Lyral ® | 15.90 |
| Mimosa ABS BLO | 0.30 |
| Nebulone ® | 6.00 |
| Orange Oil FLA | 4.00 |
| Prenyl Acetate | 5.00 |
| Trisamber ® 1% DPG | 0.20 |
| Verdox ® | 5.00 |
| Total | 100.00 |

The above fragrance formula has fruity, juicy, sweet, natural berries, pineapple, aldehydic, creamy (orange creamsicle) odor characters, which were stronger than the formulas without exo bicyclo[2.2.1]hept-5-ene-2-carboxylic acid, ethyl ester.

What is claimed is:

1. A method of improving, enhancing or modifying a fragrance formulation through the addition of an olfactory acceptable amount of a compound:

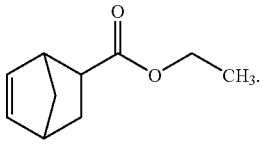

2. The method of claim 1, wherein the compound has the NMR spectral characteristics of:

$^1$H NMR ($CDCl_3$, 500 MHz): 1.24 ppm (td, 3H, J=7.12, 0.73 Hz), 1.28 ppm (d, 1H, J=8.15 Hz), 1.43 ppm (d, 2H, J=8.53 Hz), 1.90 ppm (td, 1H, J=10.75, 3.43 Hz), 2.90 ppm (s, 1H), 2.92-2.96 ppm (m, 1H), 3.21 ppm (s, 1H), 4.05-4.13 ppm (m, 2H), 5.94 ppm (m, 1H), 6.19 ppm (m, 1H).

3. The method of claim 1, wherein the compound has the NMR spectral characteristics of:

$^1$H NMR ($CDCl_3$, 500 MHz): 1.26 ppm (t, 3H, J=7.13 Hz), 1.33-1.38 ppm (m, 2H), 1.53 ppm (s, 1H,), 1.86-1.95 ppm (m, 1H), 2.19-2.23 ppm (m, 1H), 2.89-2.95 ppm (m, 1H), 3.03 ppm (s, 1H), 4.14 ppm (q, 2H), 6.10 ppm (dd, 1H, J=5.53, 3.03 Hz), 6.13 ppm (dd, 1H, J=5.55, 2.89 Hz).

4. The method of claim 1, wherein the compound is an isomeric mixture of:

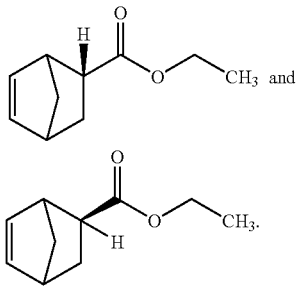

5. The method of claim 1, wherein the olfactory acceptable amount of the compound is from about 0.005 to about 70 weight percent of the fragrance formulation.

6. The method of claim 1, wherein the olfactory acceptable amount of the compound is from about 0.1 to about 50 weight percent of the fragrance formulation.

7. The method of claim 1, wherein the olfactory acceptable amount of the compound is from about 0.2 to about 25 weight percent of the fragrance formulation.

* * * * *